United States Patent [19]

Epperson

[11] Patent Number: 4,965,421

[45] **Date of Patent: * Oct. 23, 1990**

[54] PARTICULATE SPACERS FOR TOUCH SENSITIVE OVERLAY PANEL APPLICATIONS

[75] Inventor: David L. Epperson, Granite Falls, Wash.

[73] Assignee: John Fluke Mfg. Co., Inc., Everett, Wash.

[ * ] Notice: The portion of the term of this patent subsequent to Sep. 29, 2004 has been disclaimed.

[21] Appl. No.: 269,749

[22] Filed: Nov. 8, 1988

Related U.S. Application Data

[63] Continuation of Ser. No. 904,841, Sep. 5, 1986, abandoned, which is a continuation-in-part of Ser. No. 780,313, Sep. 26, 1985, abandoned.

[51] Int. Cl.[5] ..... H01H 1/10

[52] U.S. Cl. ..... 200/514; 200/512; 200/5 A; 428/325

[58] Field of Search ..... 200/159 B, 5 A, 512, 200/514; 428/325; 427/427, 108–110

[56] References Cited

U.S. PATENT DOCUMENTS

| | | | |
|---|---|---|---|
| 4,229,633 | 10/1980 | Gillilan . | |
| 4,423,299 | 12/1983 | Gurol et al. | 200/159 B |
| 4,449,023 | 5/1984 | Hilhorts et al. | 200/159 B |
| 4,467,151 | 8/1984 | Johnson et al. | 200/159 B |
| 4,525,606 | 6/1985 | Sado | 200/5 A |
| 4,594,482 | 6/1986 | Saito et al. | 200/159 B |
| 4,696,860 | 9/1987 | Epperson | 428/325 |

FOREIGN PATENT DOCUMENTS

| | | |
|---|---|---|
| 109159 | 5/1984 | European Pat. Off. . |
| 1255761 | 12/1971 | United Kingdom . |
| 2029073 | 3/1980 | United Kingdom . |
| 2049290 | 12/1980 | United Kingdom . |
| 2064873 | 6/1981 | United Kingdom . |

*Primary Examiner*—Linda J. Sholl

*Attorney, Agent, or Firm*—Stephen A. Becker

[57] ABSTRACT

Fine particles, of predetermined composition and sized to be within a predetermined size range, are deposited on, and thereafter adhere in random distribution to, one of two adjacent surfaces, serving to keep the surfaces uniformly spaced apart except when an external force causes them to make local contact. The particles are conveniently applied in the form of a spray of a suspension of particles and a fluid carrier material, preferably water with alumina particles, or an aqueous solution of a chloride salt of an alkaline earth metal such as calcium, potassium or sodium when small glass beads are used as the particles. Brown alumina particles (approximately 96% $Al_2O_3$) in the size range 3-50 microns, so utilized, are found well suited as parallel surface spacers in optically transparent touch sensitive overlay (TSO) panels. Particle distribution densities in the range 300–1,000 particles per inch are satisfactory for TSO panels, with the higher particle density requiring a higher actuation pressure to be applied.

27 Claims, 2 Drawing Sheets

PARTICULATE SPACERS FOR TOUCH SENSITIVE OVERLAY PANEL APPLICATIONS

This application is a continuation-in-part, of Application Ser. No. 904,841, filed Sept. 5, 1986, now abandoned which is a continuation-in-part of application Ser. No. 780,313 filed Sept. 26, 1985.

TECHNICAL FIELD

This invention relates generally to the provision of particulate spacers, of small dimensions, for placement between adjacent and normally parallel layers in a touch sensitive overlay (TSO) assembly to prevent contact between the layers until an external force, e.g., pressure by a finger, is provided to obtain such a contact deliberately at a determinable location.

BACKGROUND OF THE INVENTION

A great variety of apparatus is currently in use in which various operations are performed by the application of external force, e.g., by a user's finger, to obtain optical or electrical contact between two adjacent, closely spaced apart flexible layers to generate signals which are generally processed further by an external electrical circuit. Examples of these include elevator floor selection buttons, certain computer terminals, and, lately, touch sensitive overlay screens that permit the user of a computer monitor to manipulate records stored within the computer.

When a touch sensitive overlay (TSO) assembly is utilized with a computer monitor, in a manner that requires that light be transmitted through multiple transparent layers so that the user may manipulate data stored within the computer, it has become increasingly important that spacing apart of adjacent optically transparent, and sometimes also electrically conductive, layers within the TSO assembly be achieved by optically non-intrusive means. One approach is to provide small plastic non-conductive bumps or points, as best seen in FIGS. 1 and 2, between adjacent pressure-sensitive electrically conductive layers to separate them. Such plastic spacer bumps are usually distributed in a uniform manner and are visible, and therefore are intrusive to the user. An example of such an approach is found in U. S. Pat. No. 4,423,299, issued to Gurol et al in 1983, for a "Touch Sensitive Transparent Switch Array".

As an even more general proposition, even for light-opaque adjacent closely spaced layers, e.g., a touch sensitive key-board face lighted from the user's side, it may be very desirable to ensure either electrically conductive or non-conductive separation in a predetermined manner.

A need, therefore, exists for a simple, inexpensive solution to the problem of separating two normally parallel layers by a predetermined distance without eliminating the facility for an external force to cause the surfaces to move closer to each other to thereby obtain a positionally determinable contact between them. When the layers to be separated are electrically conductive, the separation between them must be provided electrically non-conductively.

DISCLOSURE OF THE INVENTION

Accordingly, it is an object of this invention to provide easily applied and inexpensive means for separating two adjacent, closely spaced, essentially parallel surfaces by a predetermined small distance.

It is another object of this invention to provide means for electrically non-conductively separating two electrically conductive surfaces of optically transparent adjacent layers in a TSO assembly.

It is yet another object of this invention to separate by a small predetermined distance two adjacent, normally parallel, surfaces of two adjacent layers in a TSO assembly such that a predetermined pressure applied by a user to one side of the assembly will effectuate positionally determinable contact between the two adjacent surfaces.

It is a further object of this invention to provide an optically non-intrusive means for separating two adjacent, closely spaced, normally parallel surfaces spaced apart so that a controlled pressure by a user can generate in a coupled electrical circuit a signal indicative of the location at which the pressure is applied.

It should be understood that "optically transparent" is a term that comprehends "translucent" as well as "partially transparent and partially opaque", both physically and temporally (e.g., when a liquid crystal display is included).

These and other objects of this invention are achieved by depositing fine particles of a suitable material, in a predetermined area density and within a predetermined particle size range, onto one of the two adjacent surfaces of two adjacent layers. The material of the particles preferably is optically non-intrusive, chemically inert, and relatively inexpensive to apply for use. A suitable material for this purpose is brown alumina particles, which may be readily sprayed in suspension in water onto a surface to be treated. The water evaporates and leaves behind a random distribution of the particles which, when an adjacent surface is juxtaposed therewith, keeps the surfaces separated by a small predetermined distance characterized by the largest of said particles. Pressure by a user onto the layer bearing one of the separated surfaces permits contact between the adjacent surfaces on either side of the particles without any deleterious effects on either the surfaces or, in the preferred embodiment, on electrically conductive very thin films which may be vacuum deposited onto the flexible surfaces. Small glass beads, suspended in a chloride solution of an alkali earth metal, likewise, provide satisfactory separation. Brown alumina particles and glass beads are very hard, hence for certain applications it may be preferable to employ small uniformly spherical particles of semi-rigid gel-like hydrophilic vinyl polymer material, e.g., FRACTOGEL TSK HW-C. The carrier fluid evaporates in each case and leaves behind a suitable random distribution of the optically non-intrusive fine particles which adhere to the surface onto which they were sprayed, for location thereafter between the adjacent electrically conductive layers. While the true cause responsible for the desired adherence of the fine particles to the surface they are sprayed on is not fully understood, it is believed that for materials such as brown alumina or glass beads this adherence is due to small or molecular bonding forces otherwise known as van der Waal's forces. On the other hand, FRACTOGEL particles may adhere to the sprayed surface for other readsons, e.g., due to local contact receptor areas on the polymar particle surfaces. Thus the particles do not depend on pressure by one of the spaced-apart surfaces acting against the other surface to maintain the particulate distribution in place. It is believed that the fluid carrier also serves to avoid or prevent the exertion of van der Waal's forces between particles, thus providing the desired random distribution of particles adhering to the sprayed-on surface.

BRIEF DESCRIPTION OF THE DRAWINGS

FIG. 6 is a schematic enlarged representation of spherical vinyl polymer particles applied to a surface.

FIG. 7 is a cross sectional view normal to the view of FIG. 6, showing the two adjacent surfaces separated by simultaneous contact on opposite sides of the particles.

The same numbers are used to identify like elements, or parts of elements, in each of the drawings and for purposes of reference elsewhere.

BEST MODE FOR PRACTICING THE INVENTION

Figure 1:
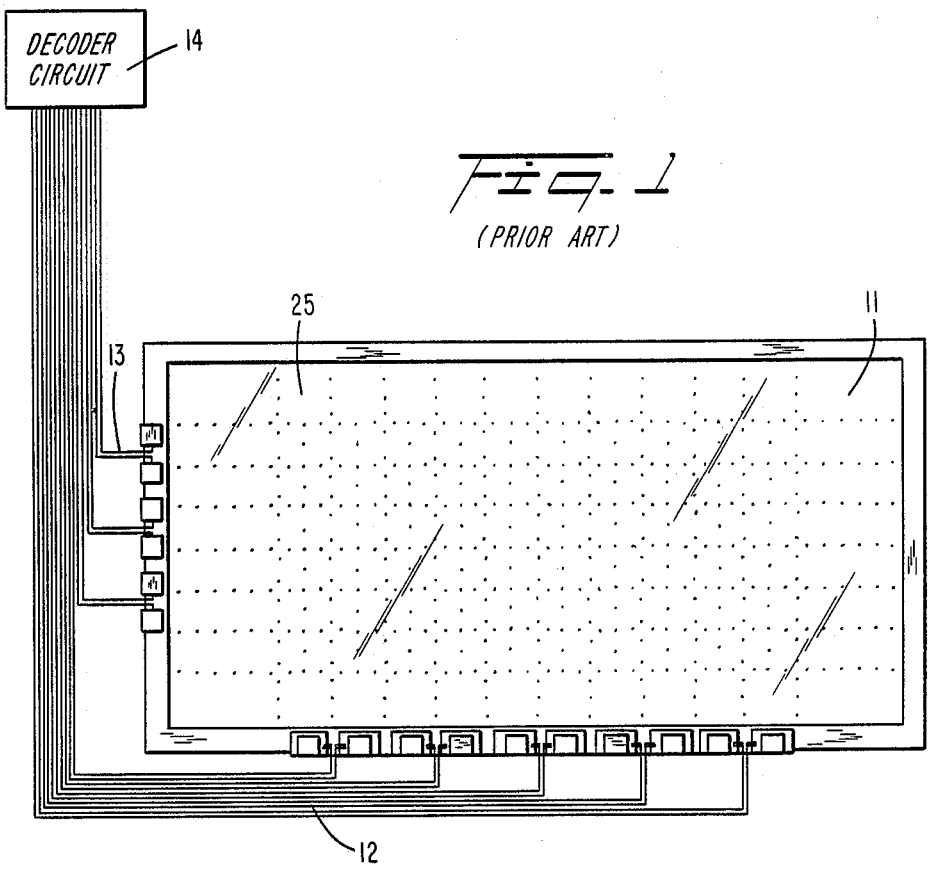
FIG. 1 (PRIOR ART)
FIG. 1 is a plan view of a typical, flat, conventional TSO assembly, in which is visible through the transparent layers a regular pattern of dots representing the plastic spacers between two closely spaced layers which, in this case, have electrically conductive adjacent surfaces.

The description below focuses on the use of nonconductive fine particulate spacers between adjacent closely spaced-apart essentially parallel surfaces and on a method for obtaining satisfactory distributions of such particles for this purpose. In the preferred embodiment the spaced apart surfaces have selectively oriented electrically conductive zones between which electrical contact is possible under the action of an external force. FIG. 1 is a plan view of a conventional flat, generally rectangular, TSO panel 11 which is electrically connected at its periphery by wires in sets 12 and 13 to a decoder circuit 14 which is most likely to be connected to a computer not shown for simplicity. Persons skilled in the art will recognize that other geometries involving closely spaced apart surfaces, e.g., with cylindrical or spherical shapes, are feasible and at times even desirable. The geometry of the surfaces generally, or the particular use thereof, in no way detracts from the usefulness of this invention as taught here.

Touch sensitive panels need not necessarily have electrically conductive surfaces to allow determination of the point of contact under the action of an externally applied force, e.g., by means of a stylus or a user's finger. Examples of the use of touch sensitive panels based on photo-voltaic modes of operation, i.e., not utilizing electrically conductive contactable surfaces, are to be found in U. S. Pat. No. 4,484,179 to Kasday, titled "Touch Position Sensitive Surface", and in IBM Technical Disclosure Bulletins: Vol. 24 No. 6 Nov. 1981, titled "Optical Overlay Input Device for a Cathode Ray Tube", and Vol. 26 No. 6 Nov. 1983, titled "Optical Keyboard Device and Technique", respectively. The principal need in both types of touch sensitive panels, i.e., those with and without electrically conductive adjacent contactable surfaces, is to maintain normal separation of the adjacent surfaces until an externally applied force causes them to contact, and then to establish the location of the point of contact by processing a signal produced as a result of such contact. Persons skilled in the art will readily appreciate that such adjacent surfaces need not necessarily be flat and also that one or both may even be optically non-transparent at selected locations. These, however, are variations on a theme and the present invention, as disclosed herein, will serve to keep such adjacent surfaces apart in predetermined separation regardless of the mode by which the signals are generated, transmitted or processed subsequently. Clearly, if electrically conductive surfaces are to be separated physically by small such particles or beads, as taught and claimed herein, then such particles or beads must be electrically non-conductive. The preferred embodiment discussed herein is one in which electrically conductive surfaces are separated; however, persons skilled in the art will readily appreciate the very broad scope of application of the invention.

Figure 2:
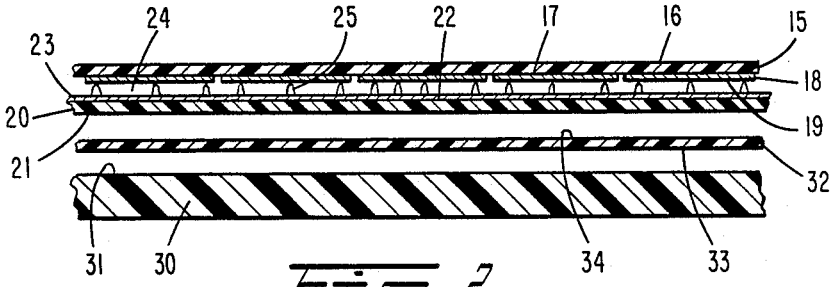
FIG. 2 (PRIOR ART)
FIG. 2 is a cross section normal to the plan view of FIG. 1, of the same conventional TSO assembly, to display the multitudinous layers contained therein.

FIG. 2 is a vertical cross section of the panel of FIG. 1 in a direction normal to the panel plane.

A typical TSO panel of the conventional sort, as best seen in FIG. 2, contains a top flexible optically transparent layer 15 that has an exterior upper surface 16 and a lower surface 17. To lower surface 17, is attached a thin electrically conductive film 18, generally by vacuum deposition, of a predetermined pattern of electrically conductive metal, that has a lower surface 19. Depending on the application at hand, the use of metallic oxides, mixtures of metals, or of metal and metallic oxide may be found desirable for such an electrically conductive predetermined pattern. There is a second optically transparent flexible layer 20, normally parallel to layer 15, that has a top surface 22 and a bottom surface 21. To surface 22 is applied, again preferably by vacuum deposition of metal, a predetermined pattern of electrically conductive material 23 having a top surface 24. As FIG. 2 shows, a conventional approach for assuring a predetermined separation of the two electrically conductive surfaces 19 and 24 is to provide a predetermined pattern (as best seen in FIG. 1) of electrically non-conductive bumps such as 25. These bumps 25, shown in FIG. 2 as based on the lower layer 20, are in physical contact with surface 19 of the upper electrically conductive film 18. Underneath layer 20, in some conventional TSO panels, is yet another layer 32 which typically is not electrically conductive and serves to defeat the formation of Newton rings when layer 20 rests against a generally clear backing plate 30 having an upper surface 31.

Figure 3:
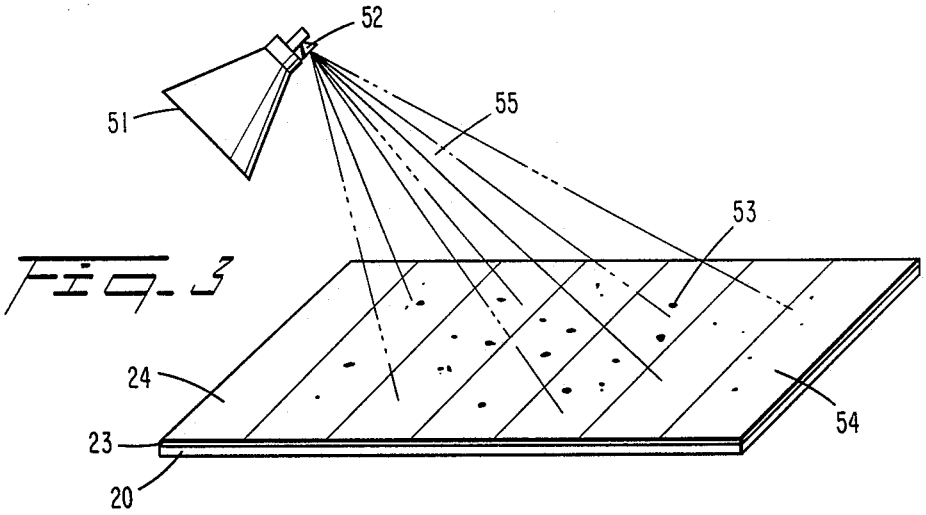
FIG. 3 is a schematic illustration of a conventional spray apparatus from which a suspension of the particles and fluid carrier material is sprayed onto a surface.

FIG. 3 schematically depicts the application, by means of a conventional spray apparatus 51 through a spray nozzle 52, of a spray 55 which results in the deposition of larger particles 53 and smaller particles 54, within a predetermined size range for such particles, onto the upper surface 24 of an electrically conductive pattern 23 deposited on the top surface of an optically transparent layer 20. Persons skilled in the art will recognize that for such a TSO panel to work satisfactorily where the operator has to be able to see what is behind the panel, as when such an assembly is positioned directly in front of a computer optical monitor, electrically conducting metal deposits 18 and 23 generally are extremely thin, probably only a few atoms thick. At such minute thicknesses, with highly conductive metals such as gold deposited thereon in a vacuum deposition process of known type, the electrically conducting layer is so thin that most of the light incident on the transparent layer beneath it is transmitted through. The use of spherical particles of a material softer than brown alumina or glass, e.g., FRACTOGEL vinyl polymer, may be particularly advantageous in such applications.

The spray 55 contains not only the particles 53 and 54 within the specified size range but also contains a fluid such as water to hold the particles in suspension during the spraying action. Research shows that brown alumina (approximately 96% $Al_2O_3$) in the size range 3–50 microns, preferably suspended in water, provides the desired effect. Other comparable electrically non-conductive and chemically inert, and therefore stable, materials include white alumina and small glass beads An aqueous solution of a chloride of an alkaline earth metal, such as potassium, sodium, or calcium, is found to be particularly effective as a fluid carrier for particles such as glass beads. While it is not completely understood what processes and molecular level forces are involved, it is found that upon drying out of the carrier the particles have a tendency to adhere very firmly to typically suitable optically transparent materials such as acrylic plastics, glass, Mylar (TM) and polycarbonates, as well as to very thinly deposited conductive metal or oxide films as are produced by the typical vacuum deposition process. Persons skilled in the art will, of course, appreciate that a sprayed on deposition of fine particles onto a surface that has a predetermined pattern of electrically conductive zones will adhere both to not only the electrically conductive zones and to the non-conductive areas therebetween.

Figure 4:
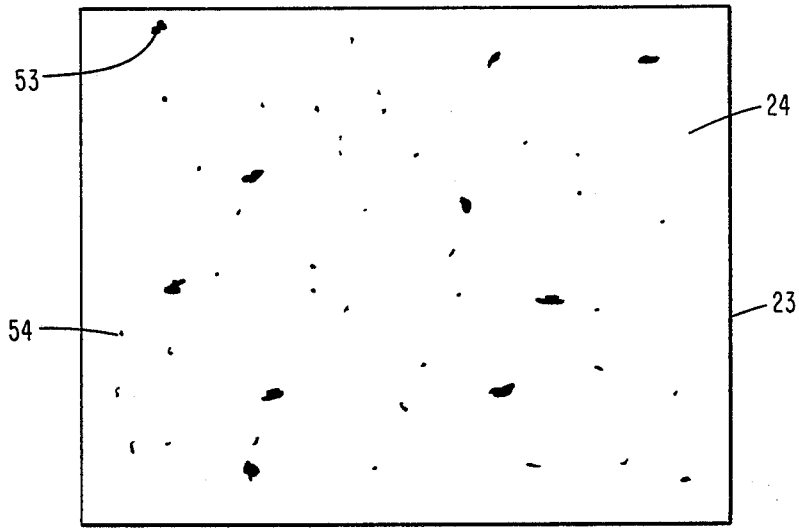
FIG. 4 is a schematic enlarged representation of the random distribution of particles within the selected size range onto a surface.
Figure 5:
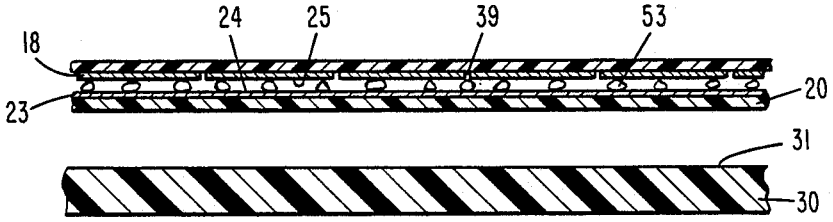
FIG. 5 is a cross sectional view normal to the view of the view of FIG. 4, showing the two adjacent surfaces separated by simultaneous contact on opposite sides of a random distribution of the larger particles deposited therebetween.

After the spraying on of the particles and the subsequent drying of the carrier material the particle covered surface is juxtaposed with a second layer which also has a predetermined pattern of electrically conductive zones. By proper selection of particles within the size range it is possible thus to ensure that the electrically conducting surfaces, while very close to each other, normally remain separated by an amount determined by the size of the largest particles which are in simultaneous contact with both the adjacent surfaces As discussed above, it is found that once the particles have been deposited onto one surface they do not move therefrom It should also be understood that it is preferable that the largest particles make simultaneous contact between the adjacent surfaces, although the smaller particles will remain in adherence to the surface onto which they were initially sprayed. This is best seen in FIG. 5 which is a cross sectional view normal to the surface shown in FIG. 4. It is easily seen here how the largest particles contact the electrically conducting surface 19 of the upper layer and the comparable electrically conducting surface 24 of the lower layer, with the smaller particles interspersed among the larger particles. Where the particles are spherical in shape, e.g, glass beads or vinyl polymer spheres, they will of course appear circular in profile in a view such as FIG. 6, wherein large particles are identified as 153 and smaller ones generally as 154. As best seen in FIG. 7, the large particles make contact with the adjacent surfaces of conductive layers 18 and 23, tending to hold them apart.

FRACTOGEL spherical particles, preferably in the size range 50–100 μm, are chemically stable for pH values in the range 1–14, thermally stable up to 100°C., and resistant to microorganisms. They are thus a safe choice for most TSO applications, and are applied in exactly the same manner and as readily as brown alumina or glass beads. Being spherical in shape, they efficiently diffuse away both CRT and ambient incident light, unlike prior art structures that generate hemispherical or conical bumps as part of one of the closely spaced-apart adjacent surfaces. See, for example, U.S. Pat. No. 4,594,482 to Saito et al., wherein it is noted that such bumps are particularly noticeable if formed on the top one of the adjacent surfaces.

A user who applies an external localized force to surface 16 (See FIG. 2) will thereby cause layer 15 to deflect inward and closer to layer 20. If the applied pressure is large enough then, despite the presence of particles 53 and 54 in the small gap, the electrically conductive surface 19 will make localized contact with electrically conductive surface 24 and thereby complete a portion of the external circuit and generate a useful signal indicative, generally, of the location at which the force is applied. Experiments show that particles in the 3–50 micron size range do not have any deleterious effect on the conductive layers 18 and 23, nor do they cause any damage to the flexible optically transparent layers 15 and 20. Furthermore, it is found that for practical purposes brown alumina particles in the sub 100 micron range are impossible to see by an unaided eye in a TSO assembly.

It is found that a desirable density for distribution of the brown alumina particles or glass beads in the 3–50 micron size range is in the range 300–1,000 particles per square inch. For values below 300 particles per square inch there is the risk of intermittent and irregular shorting out between the electrically conductive surfaces. This is essentially the case even if the somewhat larger FRACTOGEL particles, in the 50–100 μm size range, are used.For distribution densities greater than 1,000 particles per square inch it is necessary to apply a higher actuation pressure in order to obtain electrical contact locally. Persons skilled in the art will immediately recognize that it is thus possible to regulate the actuation pressure for a TSO panel by controlling the predetermined density of distribution of particles of a given size range. This, therefore, becomes a useful design factor for such elements.

As described above, through experimental studies it has been verified that fine particles in a predetermined density of distribution, and within a predetermined size range, can be used most effectively to separate two electrically conductive surfaces that are also optically transparent, without any deleterious effects over prolonged use. Furthermore, as previously indicated, persons skilled in the art may find that for particular applications it may be preferable to utilize white alumina, small glass beads, small vinyl polymer spheres or other comparable chemically inert and stable particles which have the added inherent advantage of being physically stable at or above the temperatures at which typical computer equipment and monitors are operated.

The spray deposition of the suspension of fine particles and a carrier fluid may be obtained either by conventional hand operated atomizer type spray devices or, for more precise, sophisticated, and economically feasible processes, be achieved by computer controlled or mechanized spraying devices of a conventional nature.

It should be apparent from the preceding that the invention may be practiced otherwise as specifically described and disclosed herein, and may be used with equal efficacy in applications wherein the separated contactable surfaces are not electrically conductive. Modifications may, therefore, be made to the specific embodiments disclosed here without departing from the scope of this invention and are intended to be included within the claims appended below.

What is claimed is:

1. An apparatus in which two closely spaced apart normally parallel layers of material are positioned to be moved closer relative to one another in order to establish local contact therebetween only when and where one of the normally parallel layers is subjected to the action of an external force, comprising:

a first layer of a first transparent material comprising a first surface and a parallel second surface;

a second layer of a second transparent material comprising a third surface and a parallel fourth surface, said third surface being positioned adjacent and parallel to said second surface of said first layer;

optically-transparent, randomly non-uniformed sized, substantially similarly shaped particles comprising a third material which are randomly distributed in a predetermined density between said first and second layers and adhered to at least one of said second and third surfaces, wherein a largest-sized portion of said particles are in simultaneous contact with said second and third surfaces and said first and second layers are maintained separate at a corresponding distance apart in the absence of an external force applied onto one of said layers such that said adjacent surfaces are placed in contact with one another when and where said external force is applied.

2. The apparatus of claim 1, wherein: said particles are spherical.

3. The apparatus of claim 2, wherein:

said optically-transparent particles are of a size about 3 to 100 microns and are randomly distributed at a density of about 300 to 1,000 particles per square inch.

4. The apparatus of claim 2 wherein:

said first surface is the touch surface of a touch-sensitive overlay panel.

5. The apparatus of claim 4, wherein:

said third material is selected from the group consisting of glass beads and a vinyl polymer.

6. The apparatus of claim 4, wherein:

said particles comprise a material selected from the group consisting of an inelastic material and an elastic material.

7. The apparatus of claim 4 obtained by a method comprising the steps of:

randomly depositing and adhering said particles onto at least one said second and third surfaces in said predetermined density; and juxtaposing said second and third surfaces so that said largest-sized portion of said particles make simultaneous contact therewith.

8. The apparatus of claim 7, wherein:

said particles are deposited by spraying thereof onto at least one of said second and third surfaces.

9. An apparatus in which two closely spaced-apart light-transmitting normally parallel layers are positioned to be moved closer to one another to establish local contact therebetween under the action of an external force, comprising:

a first layer of a first optically-transparent material comprising a first surface and a parallel second surface, wherein said first surface receives incident light and transmits a first portion of said light through said first layer and out through said second surface;

a second layer of a second optically-transparent material comprising a third surface and a parallel fourth surface, said third surface being positioned adjacent to said second surface; and optically-transparent, randomly non-uniformly sized, substantially similarly shaped particles comprising a third material which are randomly distributed in a predetermined density between said first and second layers and adhered to at least one of said second and third surfaces, wherein a largest-sized portion if said particles are in simultaneous contact with said second and third surfaces and said first and second layers are maintained separate at a corresponding distance apart in the absence of an external force applied onto one of said layers such that said adjacent surfaces are placed in contact with one another when and where said external force is applied, the minimum separation between said adjacent surfaces at any location being determined in the absence of an external force by the smallest of said particles at that location.

10. The apparatus of claim 9, wherein said first transparent material is MYLAR (TM).

11. The apparatus of claim 9, wherein:

said first surface is the touch surface of a touch-sensitive overlay panel.

12. The apparatus of claim 9, wherein:

said particles are of a size about 3 to 100 microns and are randomly distributed at a density of about 300 to 1,000 particles per square inch.

13. The apparatus of claim 9, wherein:

said particles comprise a material selected from the group consisting of glass beads and a transparent vinyl polymer.

14. The apparatus of claim 13, wherein: said particles are spherical.

15. The apparatus of claim 9, wherein:

said particles comprise a material selected from the group consisting of an inelastic material and an elastic material.

16. The apparatus of claim 9, obtained by a method comprising the steps of:

randomly depositing and adhering said particles onto at least one of said second and third surfaces in said predetermined density; and juxtaposing said second and third surfaces so that said largest-sized portion of said particles make simultaneous contact therewith.

17. The apparatus of claim 16, wherein:

said particles are deposited by spraying thereof onto at least one of said second and third surfaces.

18. An apparatus in which two closely space-apart, light-transmitting, electrically-conducting, normally-parallel layers of transparent material are positioned to be moved closer relative to one another to establish local contact therebetween under the action of an external force, comprising:

a first layer of a first electrically non-conductive optically-transparent material comprising a first surface and a parallel second surface;

a first electrically-conductive material of optically-transparent thickness which is attached to said second surface in a first set of zones of predetermined shape, size and orientation;

a second layer of a second electrically non-conductive optically-transparent material comprising a third surface and a parallel fourth surface;

a second electrically-conductive material of optically-transparent thickness which is attached to said third surface in a second set of zones of predetermined shape, size and orientation, said first and second sets of electrically-conductive zones being positioned adjacent and normally parallel to one another; and electrically non-conductive, randomly non-uniformly sized, substantially similarly shaped particles comprising a third material which are randomly distributed at a predetermined density on said second set of zones, wherein a largest-sized portion of said particles are in simultaneous contact with at least one zone from each of said first and second sets and said sets of zones are thereby maintained separate at a corresponding distance apart in the absence of an external force applied onto one of said layers such that at least one zone each from each of said sets of zones are placed in electrical contact with one another where said external force is applied, the minimum separation between said adjacent surfaces at any location being determined in the absence of an external force by the smallest of said particles at that location.

19. The apparatus of claim 18, wherein:

said first transparent material is MYLAR (TM).

20. The apparatus of claim 18, wherein:

said first surface is the touch surface of a touch-sensitive overlay panel.

21. The apparatus of claim 18, wherein:

said first and second electrically-conductive materials are gold.

22. The apparatus of claim 18, wherein:

said first electrically-conductive material comprises a material selected from a group comprising metals and metal oxides.

23. The apparatus of claim 18, further comprising:

electrical pathways linking at least one zone of said first and second sets of zones to an electrical circuit.

24. The apparatus of claim 18, wherein:

said particles are of a size in the range 3 to 100 microns and are randomly distributed at a density in the range 300 to 1,000 particles per square inch.

25. The apparatus of claim 18, wherein:

said particles comprise a material selected from a group consisting of vinyl polymer and glass, in the form of beads.

26. The apparatus of claim 18 obtained by a method comprising the steps of:

randomly depositing and adhering said particles onto at least one of said first and second sets of electrically-conductive zones in said predetermined density; and juxtaposing said first and second sets of zones so that said largest-sized portion of said particles makes simultaneous contact therewith.

27. The apparatus of claim 26, wherein said particles are deposited by spraying thereof onto at least one of said first and second sets of zones.

* * * * *